US009289046B1

(12) United States Patent
Blackwell

(10) Patent No.: US 9,289,046 B1
(45) Date of Patent: Mar. 22, 2016

(54) NAIL STUD APPLICATION TOOL

(71) Applicant: JAMBERRY NAILS, LLC, Lindon, UT (US)

(72) Inventor: David Kuhlmann Blackwell, Highland, UT (US)

(73) Assignee: JAMBERRY NAILS, LLC, Lindon, UT (US)

( * ) Notice: Subject to any disclaimer, the term of this patent is extended or adjusted under 35 U.S.C. 154(b) by 0 days.

(21) Appl. No.: 14/579,471

(22) Filed: Dec. 22, 2014

(51) Int. Cl.
*A45D 29/00* (2006.01)

(52) U.S. Cl.
CPC ..... *A45D 29/001* (2013.01)

(58) Field of Classification Search
CPC ..... A45D 29/001; A45D 29/00; A45D 29/11; A45D 29/12; A45D 29/18; A45D 29/20; A45D 2200/054; A45D 2200/10; A45D 2200/1009; A45D 2200/1018; A45D 31/00; A45D 40/264; A45D 40/265; A45D 40/26; A45D 40/0027; A45D 34/045; A45D 34/043; A45D 33/00; A45D 2033/001; A45D 2033/006; A45D 2033/02; B65D 51/32; B65D 83/0876
USPC ..... 132/73, 200, 73.5, 74.5, 75, 76.5, 317, 132/318, 320, 333; 206/581, 823; 434/100
See application file for complete search history.

(56) References Cited

U.S. PATENT DOCUMENTS

| | | | | | |
|---|---|---|---|---|---|
| 1,993,837 | A * | 3/1935 | Greene | 401/129 |
| 3,951,157 | A * | 4/1976 | Idec | 401/122 |
| 4,383,539 | A * | 5/1983 | Collins et al. | 132/333 |
| 4,832,060 | A * | 5/1989 | Kingsford | 132/293 |
| 5,573,340 | A * | 11/1996 | Gueret | 401/126 |
| 5,975,088 | A * | 11/1999 | Stehman | 132/74.5 |
| 6,004,055 | A * | 12/1999 | Cheng | 401/126 |
| 6,070,595 | A * | 6/2000 | Baltierra | 132/200 |
| 6,325,075 | B1 * | 12/2001 | Sheffler et al. | 132/298 |
| 6,450,179 | B2 * | 9/2002 | Bengis | 132/297 |
| 6,474,346 | B1 * | 11/2002 | Jang | 132/307 |
| 6,615,845 | B2 * | 9/2003 | Abraskin et al. | 132/200 |
| 6,669,389 | B2 * | 12/2003 | Gueret | 401/122 |
| 6,782,894 | B2 * | 8/2004 | Shum | 132/200 |
| 7,156,572 | B2 * | 1/2007 | Gueret | 401/130 |
| 7,997,820 | B2 * | 8/2011 | Bouix et al. | 401/35 |
| 2003/0077238 | A1 * | 4/2003 | Roovers et al. | 424/63 |
| 2007/0000513 | A1 * | 1/2007 | Gueret | 132/313 |
| 2007/0017826 | A1 * | 1/2007 | Tate | 206/15.3 |
| 2008/0105272 | A1 * | 5/2008 | Thevenet | 132/200 |
| 2008/0118298 | A1 * | 5/2008 | Marzuoli | 401/185 |
| 2008/0173321 | A1 * | 7/2008 | Le | 132/200 |
| 2010/0098479 | A1 * | 4/2010 | Brantenaar et al. | 401/129 |
| 2011/0168198 | A1 * | 7/2011 | Polanish | 132/73 |
| 2012/0266905 | A1 * | 10/2012 | Best | 132/200 |
| 2013/0125921 | A1 * | 5/2013 | Celia | 132/313 |
| 2013/0263886 | A1 * | 10/2013 | Brescia et al. | 132/320 |
| 2014/0234007 | A1 * | 8/2014 | Lee | 401/121 |
| 2015/0053224 | A1 * | 2/2015 | Lundin | 132/200 |
| 2015/0053233 | A1 * | 2/2015 | Lim | 132/218 |
| 2015/0128980 | A1 * | 5/2015 | Park et al. | 132/73 |

* cited by examiner

*Primary Examiner* — Rachel Steitz
(74) *Attorney, Agent, or Firm* — Workman Nydegger

(57) ABSTRACT

A packaging system for use with a fingernail embellishment product can comprise a container configured to contain one or more solid fingernail embellishment components. The container can comprise a lid configured to close the container. A protrusion can extend from the lid and extend in a first direction. The protrusion can comprise an elastomeric embellishment receiving portion. The embellishment receiving portion can be configured to engage with a fingernail embellishment component and apply the fingernail embellishment component to a fingernail.

1 Claim, 9 Drawing Sheets

NAIL STUD APPLICATION TOOL

CROSS-REFERENCE TO RELATED APPLICATIONS

N/A.

BACKGROUND OF THE INVENTION

1. Technical Field

This invention relates to the field of decorative nail embellishments for application on fingernails.

2. Background and Relevant Art

Fingernail polish and artificial fingernails have long been a prominent fashion accessory. Many individuals expend significant time and money decorating and maintaining their fingernails. Some individuals maintain their own fingernails within their home. In other cases, individuals pay a salon to maintain and decorate their fingernails. Oftentimes, the individuals decorate their fingernails to match a particular outfit or to coordinate with a particular event.

In addition to coloring fingernails, many individuals also apply decorative embellishments to their nails. For example, an individual may desire to apply a jewel to her fingernail. The jewel may be placed on top of, or within, fingernail polish. In any case, the jewel is affixed to the fingernail in a decorative fashion.

Applying fingernail polish and other fingernail decorations can be a tedious and difficult process. For example, painting a fingernail in way that completely covers the nail and does not leave streaks requires practice and quality applicators. Similarly, applying a decorative embellishment to a fingernail can also be difficult. For example, a clumsily applied decorative embellishment may damage or smear an undercoating of fingernail polish.

Accordingly, there are a number of problems in the art relating to applying decorative embellishments to fingernails.

BRIEF SUMMARY OF THE INVENTION

Implementations of the present invention comprise systems, methods, and apparatus configured to package fingernail embellishments within a container that also comprises an embellishment applicator. Implementations of the present invention can provide an easy to use and easy to manufacture embellishment system. In particular, implementations of the present invention comprise an embellishment applicator integrated into the lid of an embellishment container. As such, an implementation of a container and lid can comprise both the container to hold the embellishments and the applicator to apply the embellishments.

Implementations of the present invention can include a packaging system for use with a fingernail embellishment product. The packaging system can comprise a container configured to contain one or more solid fingernail embellishment components. The container can comprise at least one opening that allows access to the one or more solid fingernail embellishment components, and a lid configured to block the at least one opening.

The lid can comprise a protrusion extending from an interior surface of the lid and extending in a first direction to an extreme end relative to the lid such that when the lid is positioned to block the at least one opening the extreme end extends into the container. The protrusion can comprise an embellishment receiving portion, wherein the embellishment receiving portion is configured to engage with a solid fingernail embellishment component and apply the solid fingernail embellishment component to a fingernail.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above recited and other advantages and features of the invention can be obtained, a more particular description of the invention briefly described above will be rendered by reference to specific embodiments thereof, which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention extends to systems, methods, and apparatus configured to package fingernail embellishments within a container that also comprises an embellishment applicator. Implementations of the present invention can provide an easy to use and easy to manufacture embellishment system. In particular, implementations of the present invention comprise an embellishment applicator integrated into the lid of an embellishment container. As such, an implementation of a container and lid can comprise both the container to hold the embellishments and the applicator to apply the embellishments.

Accordingly, implementations of the present invention comprise a variety of different embellishment applicator types integrated into the embellishment container. In at least one implementation, the embellishment container may comprise a conventional fingernail polish container with the novel embellishment applicator as described herein. The various implementations of the present invention provide a variety of different benefits including lower manufacturing costs, lower packaging costs, greater ease-of-use for an end-user, and other similar benefits.

Figure 1:
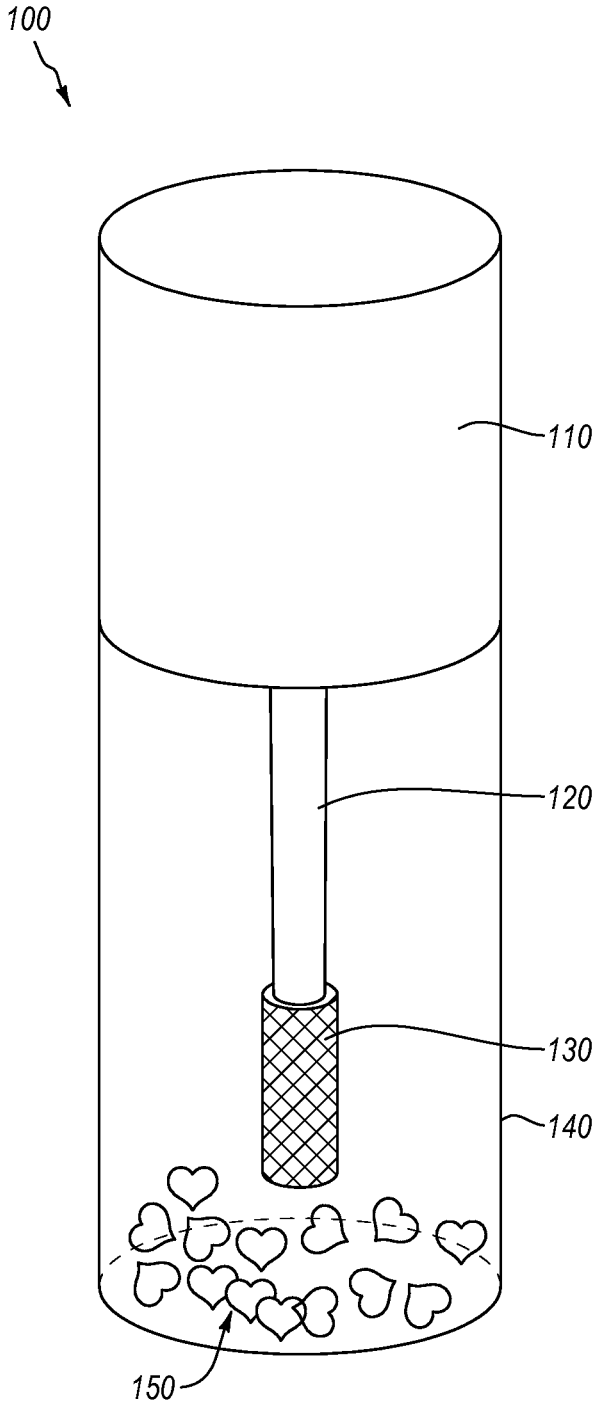
FIG. 1 illustrates an implementation of a nail stud application tool and container.

FIG. 1 depicts an implementation of a nail stud application tool and an embellishment container. The embellishment container 100 further comprises a lid 110. Extending from an interior surface of lid 110 is a protrusion 120. In various implementations, the protrusion 120 can comprise a cylindrical protrusion, a cubic protrusion, or any number of other protrusions that are capable of extending from the interior surface of the lid 110 and extending into the jar 140.

In at least one implementation, an embellishment receiving portion 130 is positioned at an extreme end of the protrusion 120 relative to the rest of the lid 110. As such, the embellishment receiving portion 130 can be distal to the lid and positioned within the jar 140. Additionally, in at least one application, the embellishment receiving portion 130 comprises an elastomeric material that comprises sufficient adhesion to lift an embellishment 150 off of a surface. For example, an elastomeric material may comprise sufficient adhesion that the embellishment 150 at least temporarily sticks to the embellishment receiving portion 130.

In various implementations, the protrusion 120 can comprise different lengths. For example, in at least one implementation, the protrusion 120 can extend such that the embellishment receiving portion 130 contacts the bottom of the jar 140. In this implementation, the embellishment receiving portion 130 can be used to interact with embellishments 150 positioned at the bottom of the jar 140. In contrast, in at least one implementation, the protrusion 120 can extend less than the entire length of the jar 140 such that at least a portion of the embellishments 150 have to be removed from the jar 140 before the embellishment receiving portion 130 can interact with them. In at least one implementation, it may be beneficial to have a shorter protrusion 120 because then the shorter protrusion can be used with a wider variety of different jars 140.

Figure 2:
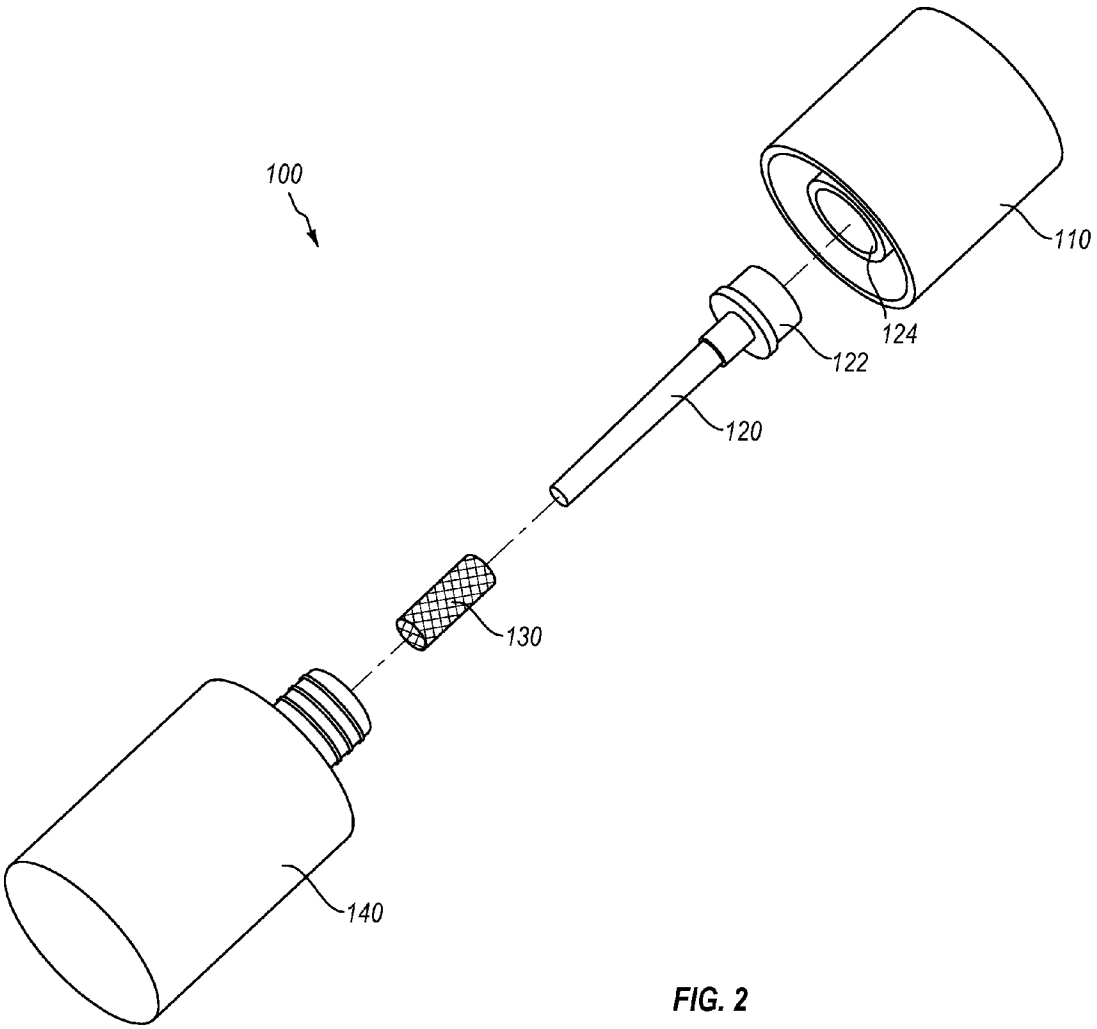
FIG. 2 illustrates an exploded view of an implementation of a nail stud application tool and container.

FIG. 2 depicts an exploded view of an embellishment container 100. In particular, FIG. 2 depicts the lid 110, the protrusion 120, the embellishment receiving portion 130, and the jar 140 as being separate components. For example, the protrusion 120 comprises a connection interface 122 that connects with a similar connection interface 124 within the interior of the lid 110. Additionally, FIG. 1 shows that the embellishment receiving portion 130 can comprise an elastomeric cap that fits around the extreme end of the protrusion 120. In particular, the elastomeric cap can comprise a silicon material, a rubber material, a plastic material, a nylon material, or any other material with sufficient adhesion to at least temporarily lift an embellishment 150 from a surface.

One will appreciate that, in at least one implementation, the connection between the protrusion 120 and the lid 110 can comprise a glue or epoxy connection. The glue or epoxy connection may allow the protrusion 120 and embellishment receiving portion 130 to be integrated into a conventional lid 110. Additionally, in at least one implementation, the protrusion 120 and embellishment receiving portion 130 can comprise a single continuous piece. As such, when converting a conventional lid 110 it may only be necessary to glue in the protrusion 120.

Figure 3:
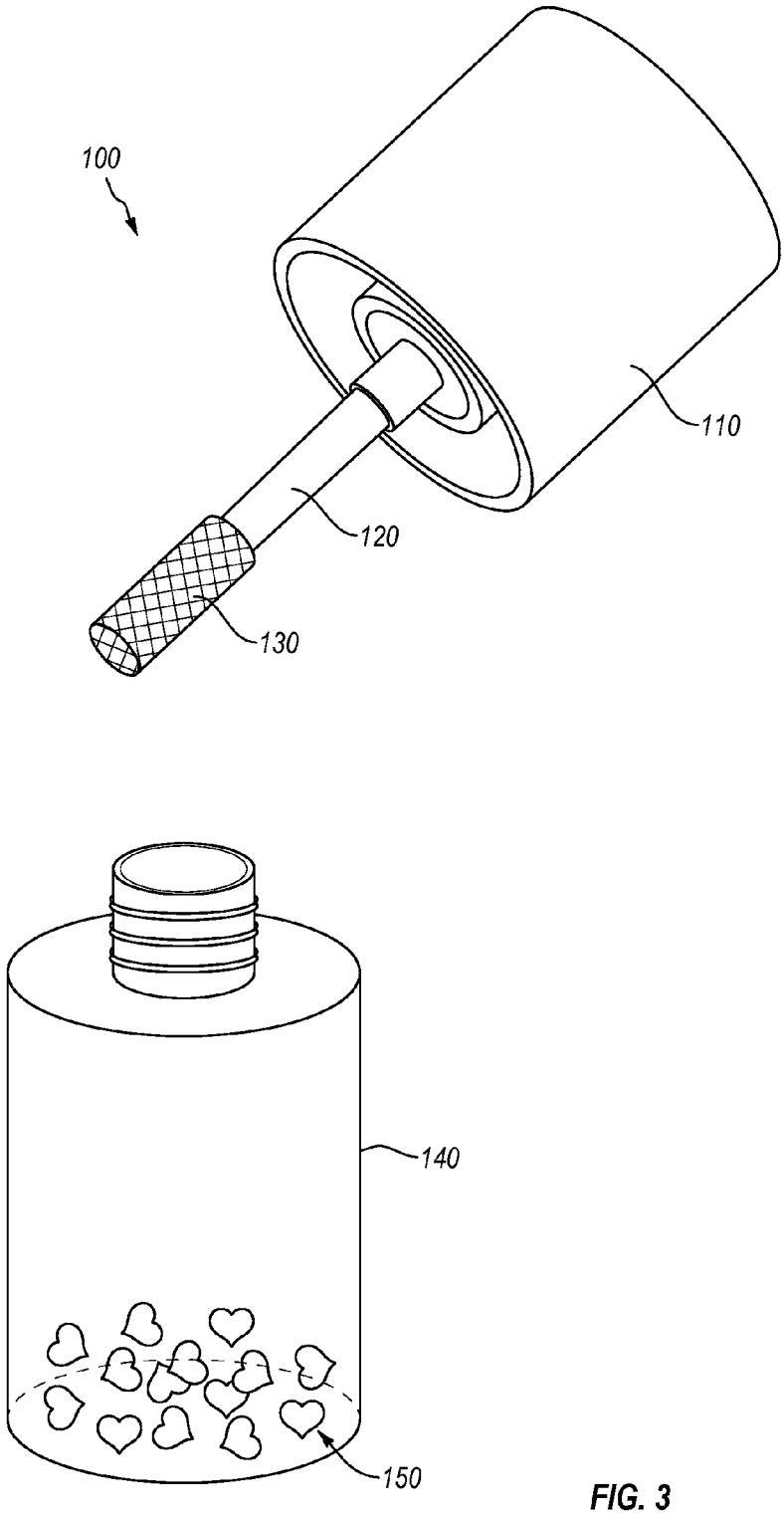
FIG. 3 illustrates another implementation of a nail stud application tool and container.

In contrast to the exploded view of FIG. 2, FIG. 3 depicts embellishment container 100 as a physically integrated unit. For example, the lid 110, the protrusion 120, and the embellishment receiving portion 130 all comprise a single continuous component. This single component is attachable to the jar 140. As such, in at least one implementation, the lid 110, the protrusion 120, and the embellishment receiving portion 130 are formed within a single mold.

Figure 4:
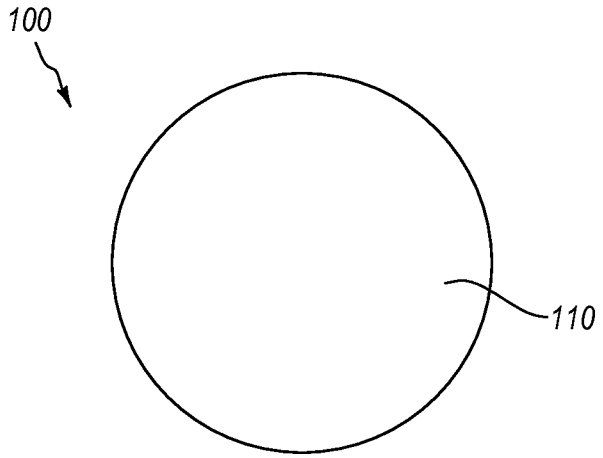
FIG. 4 illustrates a top view of an implementation of a nail stud application tool and container.
Figure 5:
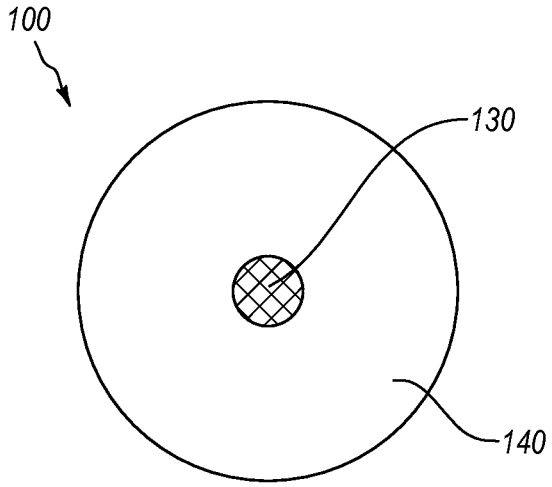
FIG. 5 illustrates a bottom view of an implementation of a nail stud application tool and container.

FIGS. 4 and 5 depict top and bottom views, respectively, of the embellishment container 100 of FIG. 1. In particular, the top view comprises a view of the upper surface of the lid 110. The bottom view comprises a view of the bottom surface of the jar 140 and of the bottom surface of the embellishment receiving portion 130. One will understand, however, that in the case that the jar 140 is opaque, the bottom surface of the embellishment receiving portion 130 may not be visible.

FIG. 6A-6D depict various steps in a method for applying an embellishment 150 to a fingernail 600 using embodiments of the present invention. For example, in FIG. 6A, a user has removed an embellishment 150 from within the jar 140. The embellishment 150 has been placed on a flat surface such as a table. The user can then hold the lid 110 and direct the protrusion 120 and embellishment receiving portion 130 towards the embellishment 150.

Figure 6A:
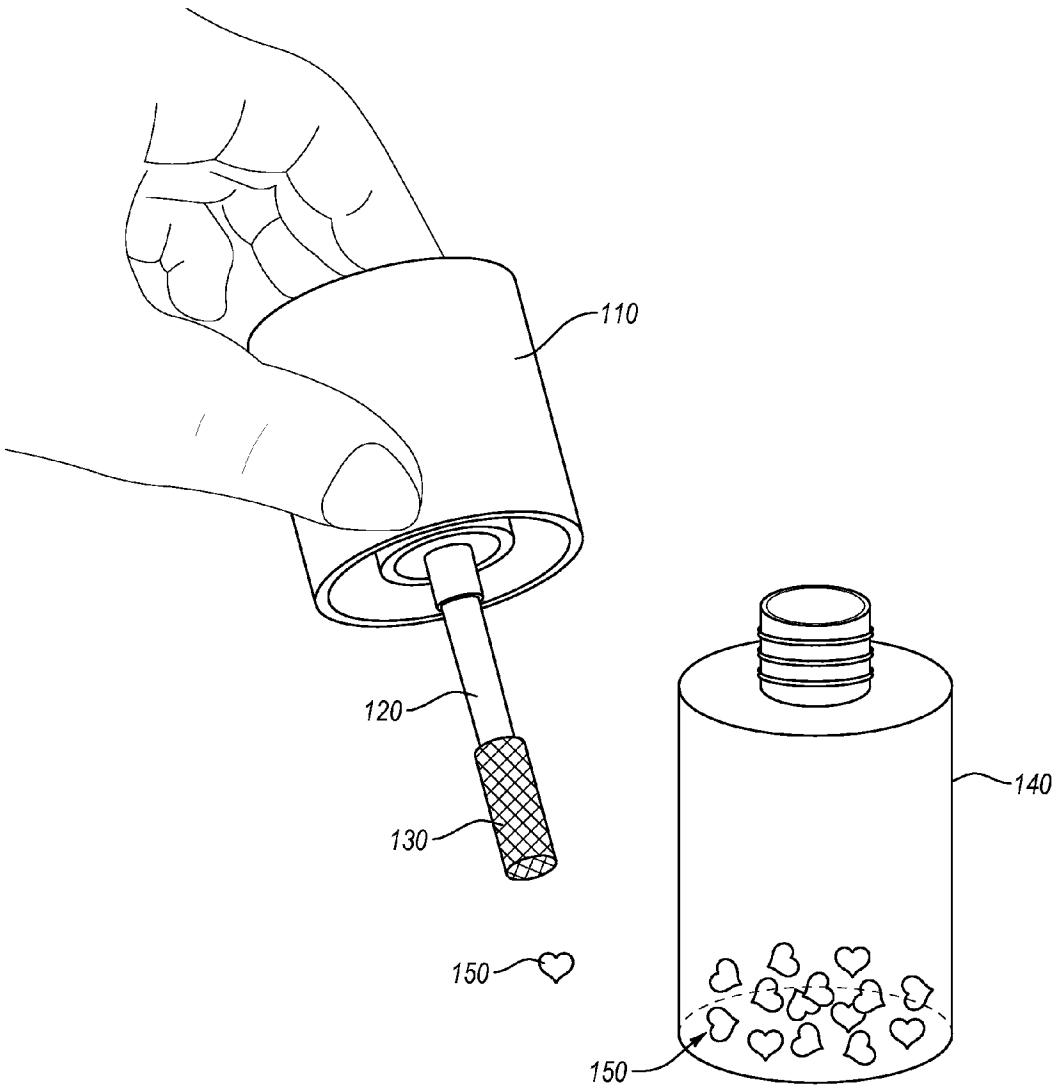
FIG. 6A illustrates an implementation of a nail stud application tool preparing to select a nail stud.
Figure 6B:
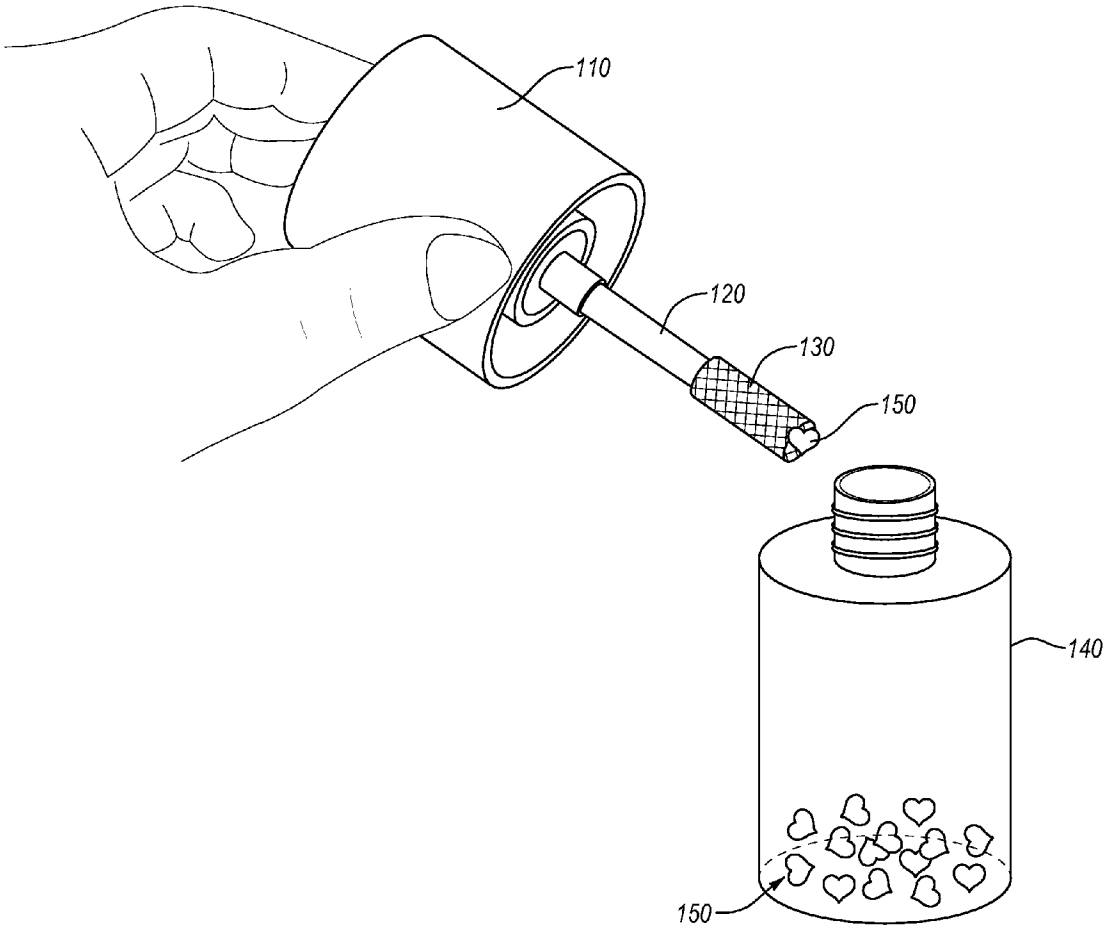
FIG. 6B illustrates an implementation of a nail stud application tool after a nail stud has been selected.

FIG. 6B depicts the embellishment receiving portion 130 attached to the embellishment 150. In at least one implementation, the embellishment receiving portion 130 comprises an elastomeric material. As such, pressing the embellishment receiving portion 130 onto the embellishment 150 can cause the elastomeric material to deform around the embellishment 150. The combination of the elastomeric material deforming and an adhesion associated with the elastomeric material may then allow the user to lift the embellishment 150 from the surface using the embellishment receiving portion 130.

In at least one implementation, the embellishment receiving portion 130 comprises a circumference that is approximately equal to or less than the circumference of the embellishment 150. As such, in the case that multiple embellishments 150 are spread on a surface, the embellishment receiving portion 130 is sized such that a user can select a single embellishment 150 from the group of embellishments 150 using the embellishment receiving portion 130.

Figure 6C:
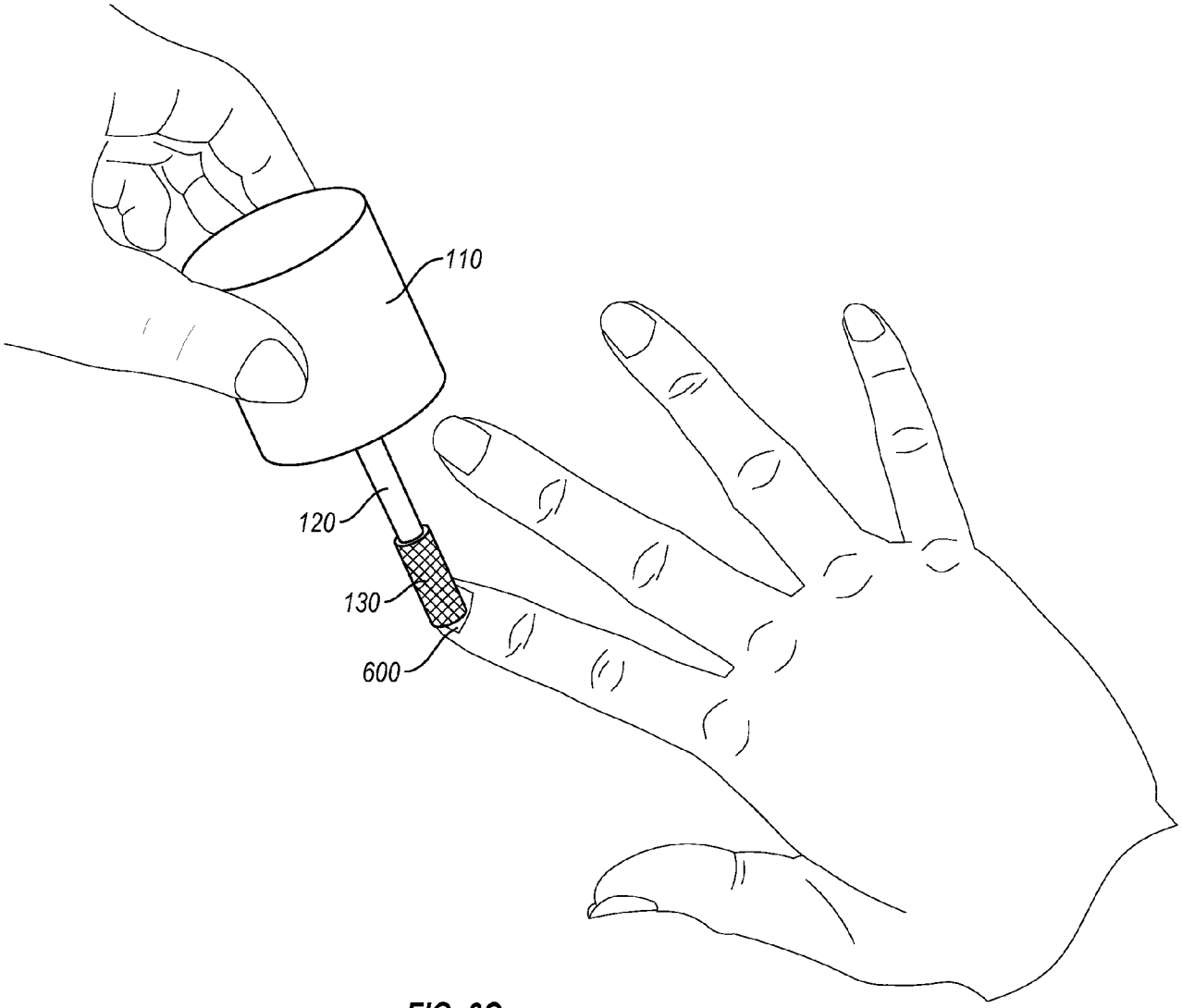
FIG. 6C illustrates an implementation of a nail stud application tool applying a nail stud to a nail.

FIG. 6C depicts a user applying an embellishment 150 to a fingernail 600. In at least one implementation, the fingernail 600 comprises a coating such as fingernail polish or lacquer. The coating may comprise a sufficient adhesion, or stickiness, to overcome the attachment between the embellishment 150 and the embellishment receiving portion 130. Accordingly, when the user applies the embellishment to a fingernail 600 using the embellishment receiving portion 130 the embellishment leaves the surface of the embellishment receiving portion 130 and remains on the surface of the fingernail 600.

Figure 6D:
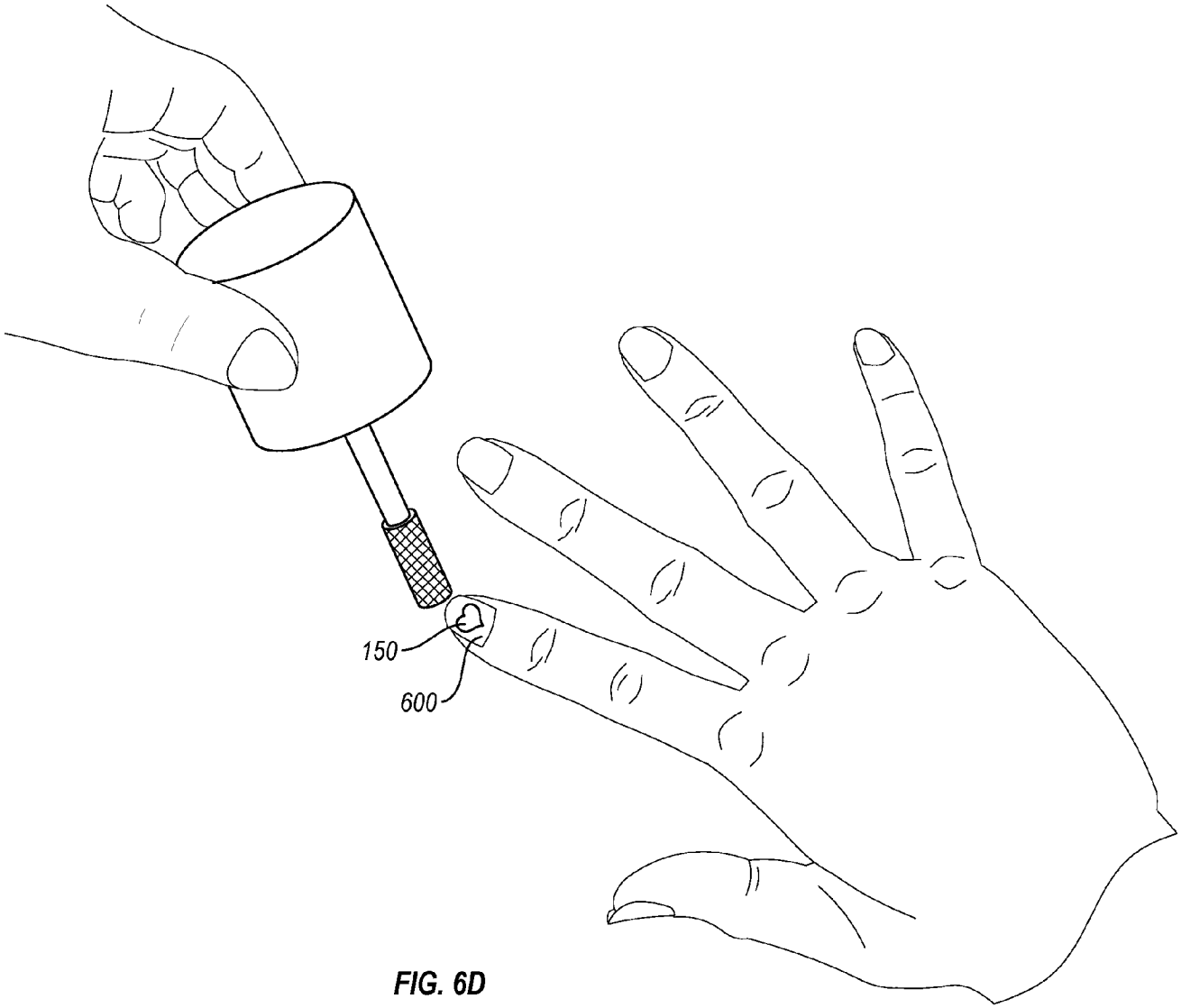
FIG. 6D illustrates an implementation of a nail stud application tool after a nail stud has been applied to a nail.

For example, FIG. 6D depicts the embellishment 150 attached to the fingernail 600. One will understand that while the depicted embellishment comprises a heart, in various implementations other types and shapes of embellishments 150 may be used. For example, embellishment may comprise a single gemstone, a sequin, a shape, or a component of a larger shape. For instance, an embellishment 150 may comprise an image that is made up of multiple components. When applying the embellishment 150 a user can selectively apply one component at a time using the embellishment receiving portion 130.

Figure 7A:
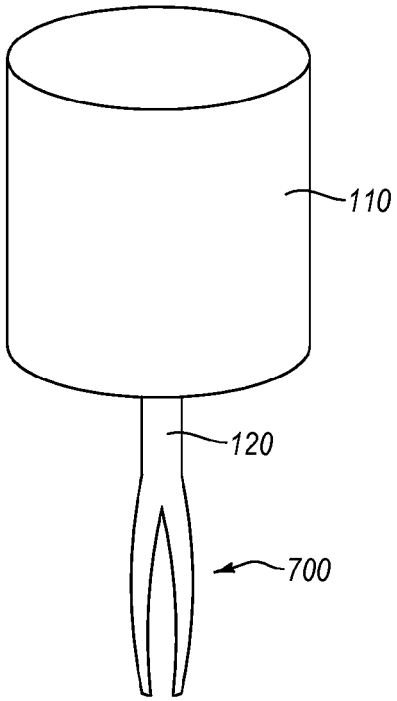
FIG. 7A depicts another implementation of a nail stud application tool.

FIG. 7A-7D depict various implementations of embellishment receiving portions 130. For example, FIG. 7A depicts and an embellishment receiving portion that comprises a set of tweezers 700. The tweezers 700 can be constructed of plastic, metal, or any other functional material. One will understand that a user can individually grab an embellishment 150 with the tweezers 700 and apply the embellishment 150 to a fingernail 600.

Figure 7B:
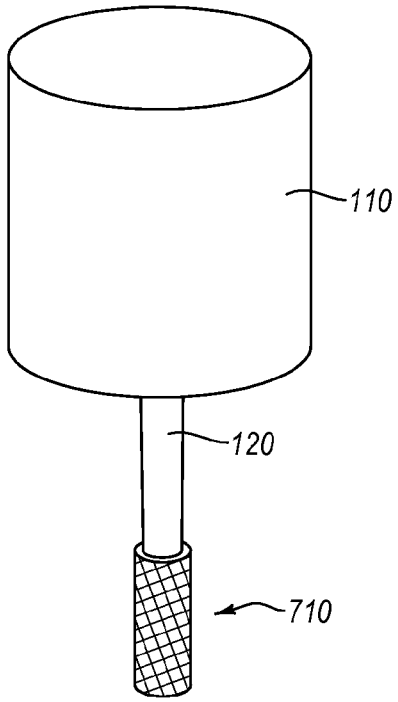
FIG. 7B depicts yet another implementation of a nail stud application tool.

In addition, FIG. 7B depicts an embellishment receiving portion 130 that comprises a high adhesion surface 710. In at least one implementation, the high adhesion surface 710 can comprise a silicone surface, a plastic surface, a nylon surface, an elastomeric surface, or any other high adhesion surface capable of lifting an embellishment 150. Further, in at least one of implementation, the high adhesion surface 710 can comprise the same material as the protrusion 120. As such, the high adhesion surface 710 can easily be made within the same mold as a protrusion 120.

Figure 7C:
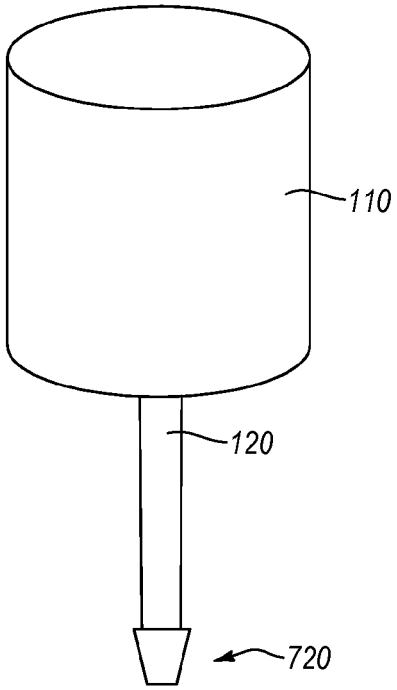
FIG. 7C depicts still another implementation of a nail stud application tool.

FIG. 7C depicts an embellishment receiving portion 130 that comprises a magnet 720. The magnet 720 can be used with embellishments 150 that also comprise magnetic properties. Additionally, the strength of the magnet 720 can be selected such that it is weaker than a force applied to an embellishment 150 by a coating or lacquer on a fingernail 600. Similar to the magnetic embellishment receiving portion 130, in at least one implementation, the embellishment receiving portion 130 can also comprise a static charge. The static charge may be such that it creates a static attraction between an embellishment 150 and the embellishment receiving portion 130.

Figure 7D:
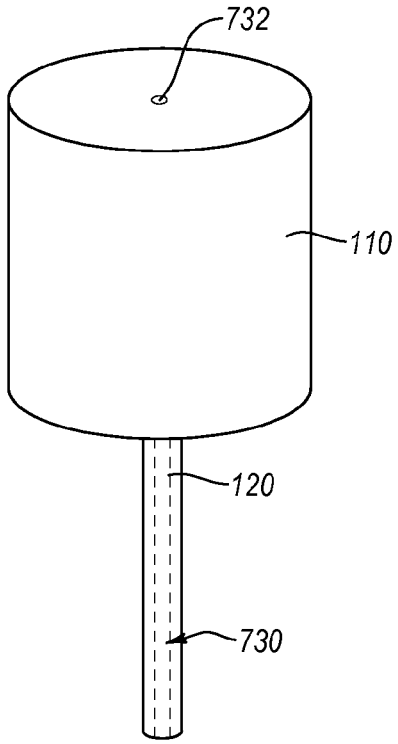
FIG. 7D depicts another implementation of a nail stud application tool.

FIG. 7D depicts an embellishment receiving portion 130 that comprises a vacuum tube to 730. In particular, the vacuum 730 in combination with the vacuum hole 732 can be used to create a vacuum hold on an embellishment 150. For example, a user can place the embellishment receiving portion 130 firmly against a surface of an embellishment 150. The user can then cover the vacuum hole 732 with a finger. Covering the vacuum hole 732 may create sufficient vacuum to lift an embellishment 150 from a surface and apply the embellishment 150 to a fingernail 600. Once the embellishment 150 is applied to a fingernail 600, the user can break the vacuum by removing their finger from the vacuum hole 732.

Accordingly, various implementations of the present invention provide a container system that comprises both a container for the embellishments 150 and an integrated applicator for the embellishments 150. Integrating the applicator into the container can provide significant benefits both when manufacturing the container 100 and when using the embellishments 150. For example, in contrast to conventional containers and applicators, implementations of the present invention allow the container and applicator to be formed within a single mold. Additionally, implementations of the present invention make it easier to ship the product because the applicator is wholly contained within the embellishment container 100 and does not require additional and/or separate packaging.

Although the subject matter has been described in language specific to structural features and/or methodological acts, it is to be understood that the subject matter defined in the appended claims is not necessarily limited to the described features or acts described above, or the order of the acts described above. Rather, the described features and acts are disclosed as example forms of implementing the claims.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

I claim:

1. A packaging system for use with a fingernail embellishment product, the packaging system comprising:

a container configured to contain one or more solid fingernail embellishment components, wherein the container comprises:

at least one opening that allows access to the one or more solid fingernail embellishment components;

a lid configured to block the at least one opening such that the lid must be removed before the one or more solid fingernail embellishment components can be removed from the container;

a protrusion extending from an interior surface of the lid, and extending in a first direction to an extreme end relative to the lid such that when the lid is positioned to block the at least one opening the extreme end extends into the container; and a solid fingernail embellishment component receiving portion connected to the protrusion, wherein:

the solid fingernail embellishment receiving portion is configured to engage with a solid fingernail embellishment component and apply the solid fingernail embellishment component to a fingernail, the solid fingernail embellishment component receiving portion comprises an elastomeric portion, and the elastomeric portion comprises a cap that is removable from the extreme end of the protrusion.

* * * * *